United States Patent [19]

Olsen

[11] Patent Number: 4,759,482

[45] Date of Patent: Jul. 26, 1988

[54] HOLSTER FOR PISTOL

[76] Inventor: Christopher K. Olsen, 15853 Vesper Rd., Valley Center, Calif. 92082

[21] Appl. No.: 857,484

[22] Filed: Apr. 30, 1986

[51] Int. Cl.[4] ..... F41C 33/02

[52] U.S. Cl. ..... 224/238; 224/911; 224/912

[58] Field of Search ..... 224/193, 198, 911, 912, 224/243

[56] References Cited

U.S. PATENT DOCUMENTS

| | | | |
|---|---|---|---|
| 1,295,831 | 3/1919 | Alderson | 224/911 X |
| 1,903,084 | 3/1933 | Arth | 224/911 X |
| 3,227,336 | 1/1966 | Dickey | 224/911 X |
| 3,265,259 | 8/1966 | Marburger | 224/193 |
| 3,550,822 | 12/1970 | Lloyd | 224/911 X |
| 3,583,611 | 6/1971 | Theodore | 224/911 X |
| 3,749,293 | 7/1973 | Bianchi | 224/911 X |
| 3,952,930 | 4/1976 | Baldocchi | 224/193 |
| 3,955,724 | 5/1976 | Perkins | 224/243 |
| 4,062,481 | 12/1977 | Clark . | |
| 4,143,798 | 3/1979 | Perkins . | |
| 4,270,680 | 6/1981 | Bianchi | 224/193 |
| 4,298,150 | 11/1981 | Seldeen | 224/911 X |
| 4,303,185 | 12/1981 | Shoemaker | 224/193 |
| 4,398,655 | 8/1983 | Perry . | |
| 4,542,841 | 9/1985 | Bianchi et al. | 224/911 X |
| 4,544,089 | 10/1985 | Tabler . | |

FOREIGN PATENT DOCUMENTS

| | | | |
|---|---|---|---|
| 3415660 | 10/1985 | Fed. Rep. of Germany | 224/911 |

OTHER PUBLICATIONS

Photocopy of Ads of Various Holsters Including the "Match 2000", Clinger II, Ted Blockers and California Challenger.

*Primary Examiner*—Henry J. Recla
*Assistant Examiner*—Robert M. Petrik
*Attorney, Agent, or Firm*—Duane C. Bowen

[57] ABSTRACT

A holster formed by two identical sandwiched blanks sewn together. The holster has an open front except for a low forward wall. The holster has an inner wall with a rigid upstanding thumb release and the holster has an outer wall with a flexible retaining strap and snap members releasably securing together the thumb release and the strap. The blanks in flat condition before being folded into a holster having a slotted ear at each end that are superposed and sewn together to form a rear holster ear to secure to a belt. In the flat condition of the blanks, the low forward wall connects together the inner and outer holster walls and a forward slotted holster ear extending from the inner holster wall, above the low forward wall, to secure to a belt. A metal liner sheet between the sandwiched blanks and extending substantially the complete area of the blanks except for the margins to be sewn together and except for the flexible retaining strap. The metal liner sheet extending throughout the areas of both ears and the upstanding thumb release.

5 Claims, 4 Drawing Sheets

Fig. 1
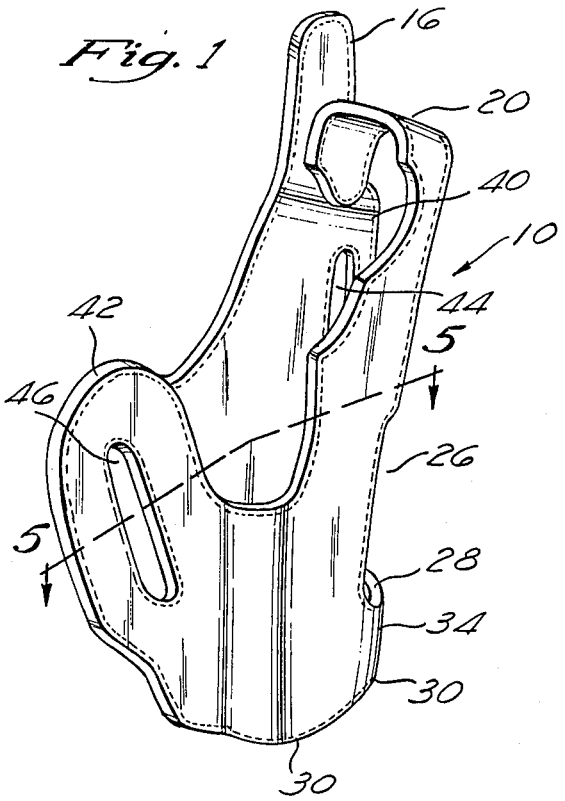
Fig. 2
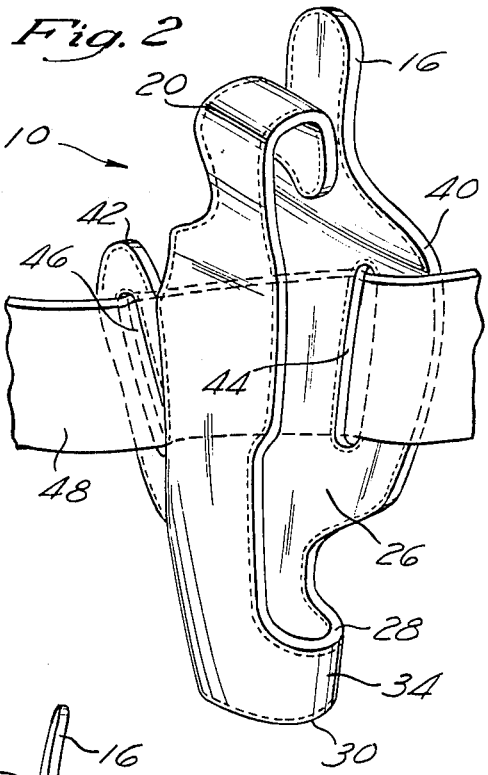
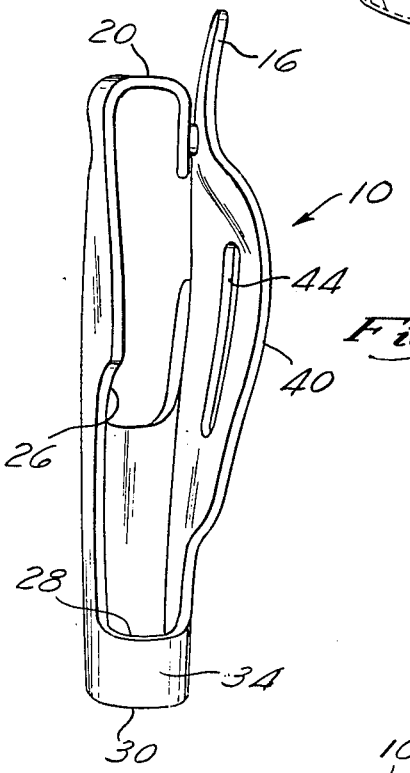
Fig. 3
Fig. 4
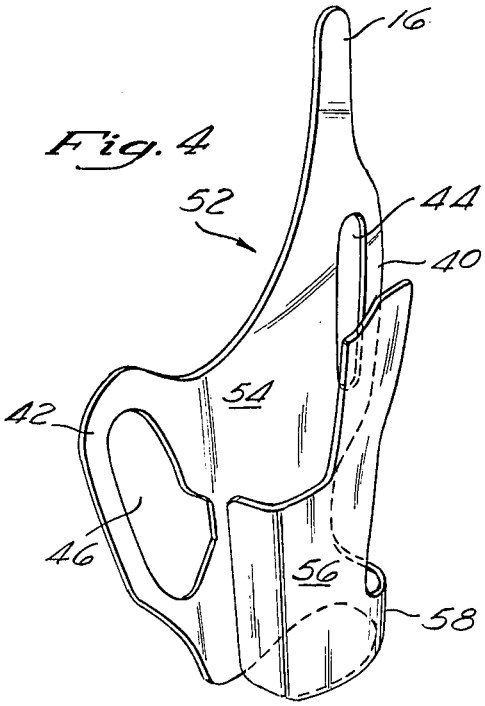
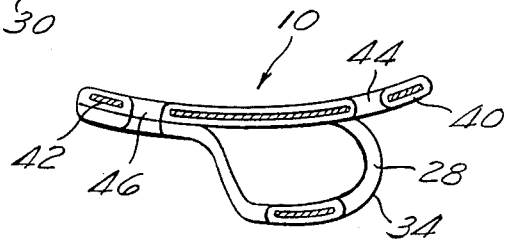
Fig. 5

HOLSTER FOR PISTOL

BRIEF SUMMARY OF THE INVENTION

BACKGROUND AND OBJECTIVES

My invention relates to a fast-draw, low-riser, out-of-the-front, concealed type holster with a security-strap, thumb released, over the top of the pistol. More specifically, the holster has an open front and a low forward bottom wall and the holster is formed substantially throughout and including the areas of forward and rear slotted ears to secure the holster to a belt from sheet material having an inner and an outer layer of leather and having a metal layer inbetween.

I am concerned with a concealed type holster which is to be distinguished not only from non-concealed holsters used in police work but also from IPSC and PPC competition fast-draw holsters that not only are non-concealed but also are adapted for fast draw competition and not for carrying pistols in police work. It is an objective of my invention to improve a concealed type holster for police work.

One known type of concealed holster has an inner rigid thumb release part upstanding from the inner holster wall and has an outer flexible retaining strap extending from the outer holster wall over the top of the pistol. The thumb release and the flexible strap are releasably secured together by snap fasteners. It is an additional objective of my invention to improve security-strap, thumb-release type pistol securement.

It is an additional objective of my invention to provide a substantially fully metal lined reinforced holster to provide good fit of the pistol to facilitate quick withdrawal.

It is a further objective of my invention to provide metal reinforcement in the areas of forward and rear slotted ears to secure the holster to a belt, in order to best hold the holster securely in the same position for quick drawing of the pistol.

Another objective is to provide a substantially open front, with a minimum low forward wall to be cleared by the pistol barrel in drawing of the weapon.

My invention will be best understood, together with additional advantages and objectives thereof, when read with reference to the drawings.

DRAWINGS

FIG. 1 is a perspective view of a specific embodiment of my new holster. This holster is designed for an automatic pistol. The viewpoint is to the outside and to the rear of the holster.

FIG. 2 is like FIG. 1 but the viewpoint is to the outside and to the front of the holster.

FIG. 3 is a view from the front end of the holster.

FIG. 4 is a view like FIG. 1 but is only of a metal reinforcement for the holster.

FIG. 5 is a cross-sectional view taken on line 5—5 of FIG. 1.

DESCRIPTION

My new holsters 10, 12, 14 are designed to be concealed, e.g., to be worn under a coat or jacket. The market is for law enforcement people. The holsters are adapted for fast draw but they should be distinguished from fast draw holsters used in competition, which are not concealed.

Figure 12:
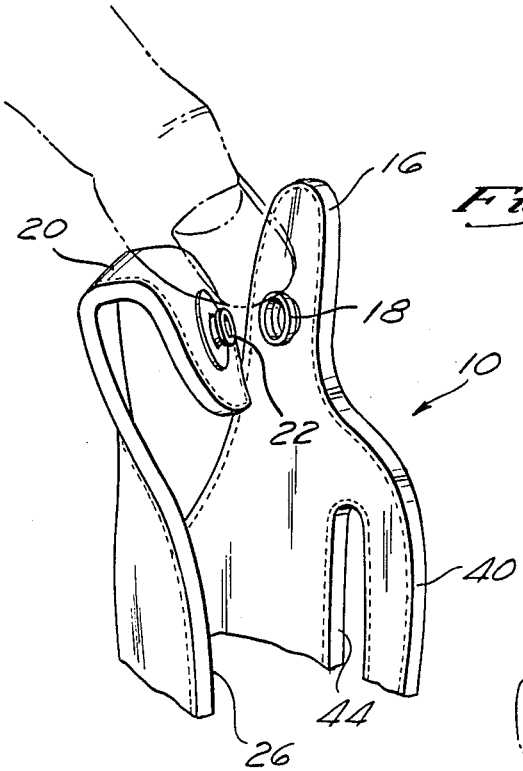
FIG. 12 is an enlarged perspective view showing unsnapping of the thumb release securement of the holster shown in FIGS. 1–5.
Figure 13:
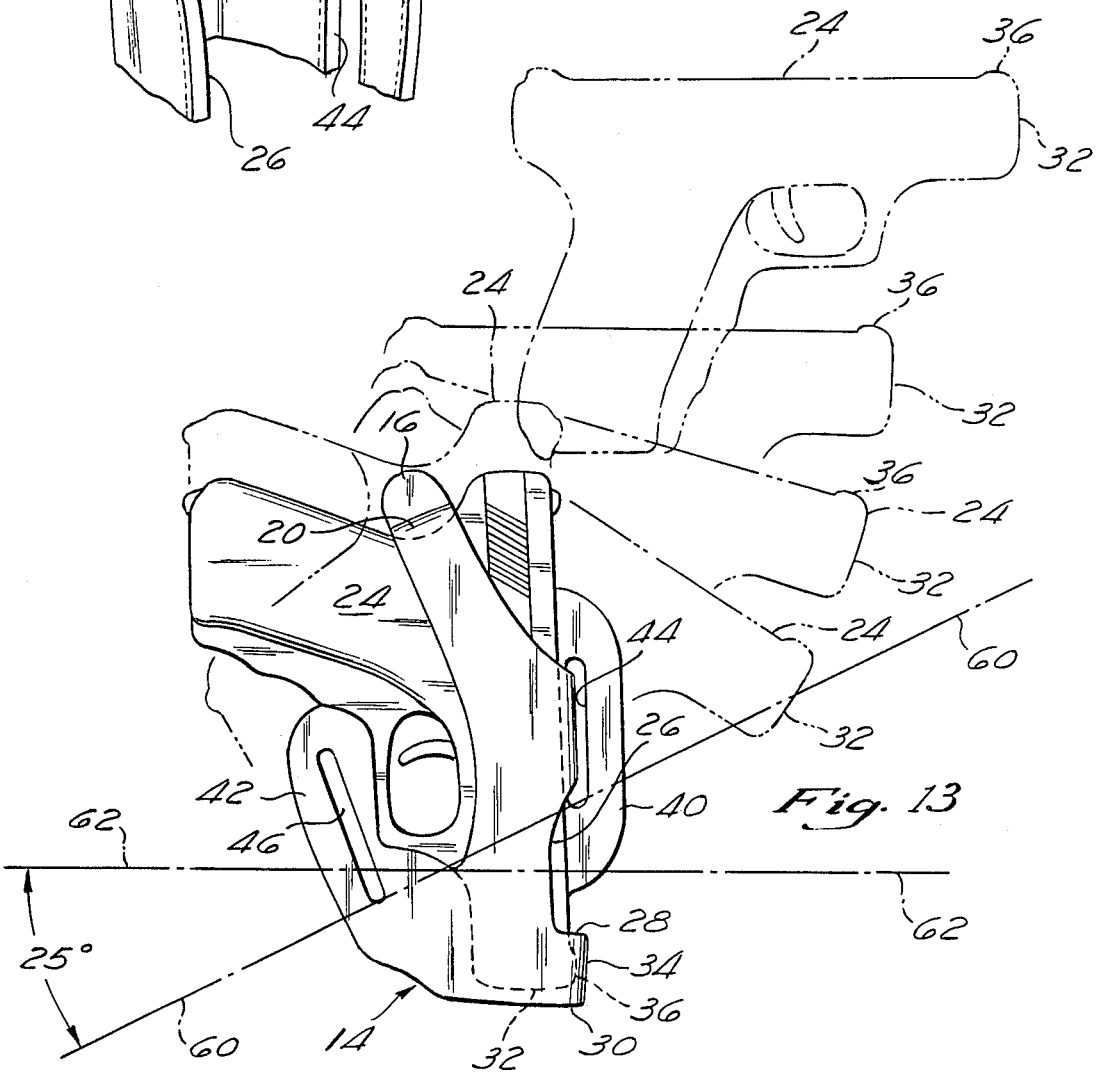
FIG. 13 is a side view of a holster showing an automatic pistol seated in the holster in full lines and showing the sequential process of withdrawal of the pistol in dashed lines.

One primary distinguishing factor from holsters used in fast draw competition is that fast draw competition is an event in which participants have essentially one location and the weapon needs to be worn for a relatively short period so that pistols require little to secure them in place, or any strap used for securement can be unfastened before competition begins. In holsters used for law enforcement, however, pistols must be secure in the holsters as the law enforcement people go about their daily tasks including standing, sitting, driving or even running or overcoming resistance to arrest. A popular way to secure concealed holsters in law enforcement work, which I use in my holsters, is to employ a so-called thumb release securement having an inner rigid upstanding thumb release part 16 with a female snap fastener member 18 spaced from its upper end and having an outer flexible retaining strap 20 with a male snap fastener member 22 engageable with female snap fastener member 18 to hold the pistol 24 down in the holster. Flexible strap 20 extends upwardly over an upper portion of the pistol 24 in the holster, as shown in FIG. 13. In drawing the weapon, snap fastener members 18, 22 are separated with minimum delay by action of the thumb on members 16, 20, as shown in FIG. 12.

My revolutionary new design allows a pistol to be drawn forward with no resistance after approximately one inch of upward movement. This distance could vary somewhat depending on the size of the pistol. In some claims I have specified this feature in terms that holsters 10, 12, 14 have open fronts 26 from their tops to levels 28 no more than an inch and a quarter from the bottoms 30 of the bodies of the holsters. In other claims I have broadened this feature to specify that holsters 10, 12, 14 have open fronts 26 from their tops to levels 28 no more than a quarter of the heights of the holsters from the bottoms 30 of the bodies of the holsters. As shown especially in FIG. 13, the pistol 24 cannot be brought forwardly until the end of the barrel 32 clears point 28 below the open front 26. The first dashed line showing of pistol 24 from the bottom indicates how high pistol 24 must be raised to clear point 28 so that pistol 24 can then be brought forwardly and barrel 32 can be pivoted forwardly as shown in the sequential dashed line showings in FIG. 13. The low forward wall 34 below open front 26 is designed to be high enough so that there can be no question but what pistol 24 is secured as to forward movement by wall 34 and by the thumb release 16 and strap 20 securement, but low forward wall 34 is otherwise designed to have minimum height. Wall 34 desirably covers and protects forward pistol sight 36.

It is difficult to define the height of wall 34, between level 28 and holster bottom 30, partly because, as illustrated in FIG. 13, barrel 32 can extend a greater or lesser distance down to the bottom 30 of the holster. A study of the drawings will show that holster bottom 30 usually will extend slightly beyond the end of barrel 32, to protect barrel 32. It would be possible, however, for barrel end 32 to extend lower than holster bottom 30, although I consider it undesirable to have the end of barrel 32 or sight 36 not be protected. Note that the bottom 30 of holsters 10, 12, 14 usually will be open in a concealed holster, as a bottom wall is not needed and would be an expensive addition. Therefore, when I specify the distance between level 28 and holster bottom 30 (the height of low forward wall 34) to be preferably a maximum of about one inch or, a little more broadly, no more than one and a quarter inches, or, even more broadly, a maximum of one quarter of the height of the holster, this should be interpreted in a common sense manner assuming that the end of the pistol barrel 32 and sight 36 is covered but the bottom 30 of the holster doesn't extend much below the end of the pistol barrel 32 as any further extension would not serve a purpose. In prior holsters of this type the front wall corresponding to wall 34 has extended to about the top of the receiver or usually covers the rear sight.

Essentially, my design allows longer or shorter barreled pistols to be carried under cover and off duty because the length of the required upward draw movement can be the same for all barrel lengths.

Holster bodies 10, 12, 14 have inner and outer body walls and low forward wall 34 bends between an inner body wall next to the user and an outer body wall away from the user the inner and outer body walls. Holster bodies 10, 12, 14 have a forward ear 40 extending forwardly from the inner body wall in the area of open front 26 and have a rear ear 42 extending rearwardly from the remainder of the holster body. Ears 40, 42 have slots 44, 46 respectively so that ears 40, 42 form belt loops to install the holsters on belts 48, as indicated in FIG. 2. Slots 44, 46 extend generally vertically.

As will appear from the following description, belt loops 40, 42 have metal reinforcement which assures holster stability and totally eliminates belt loop fatigue and stretch. Not only are the loops metal reinforced but also the remainder of the holster in contact with pistol 24 is metal reinforced which means the pistol is always exactly in the same position relative to the user's belt and body, whereas if the holster were not fully metal reinforced, the pistol would not always have to have the same position relative to the user's belt and body. The inner wall of the holster and the metal reinforcement thereof are shaped to curve around the user's body, which not only helps always locate pistol 24 in the same position on the user's body but also gives the user a feeling for exactly where pistol 24 is located and gives the user a sense of security relative to the weapon. The holster being shaped to the body, this means weapon 24 is carried closer to the body and there is more feeling as to its exact location. This also helps in concealment that a weapon is being carried under a coat or jacket.

The holster and its metal reinforcement are shaped to the pistol 24 that will be carried in the holster or to the exact same pistol model. This means that production is more handcrafted than mass produced.

Figure 10:
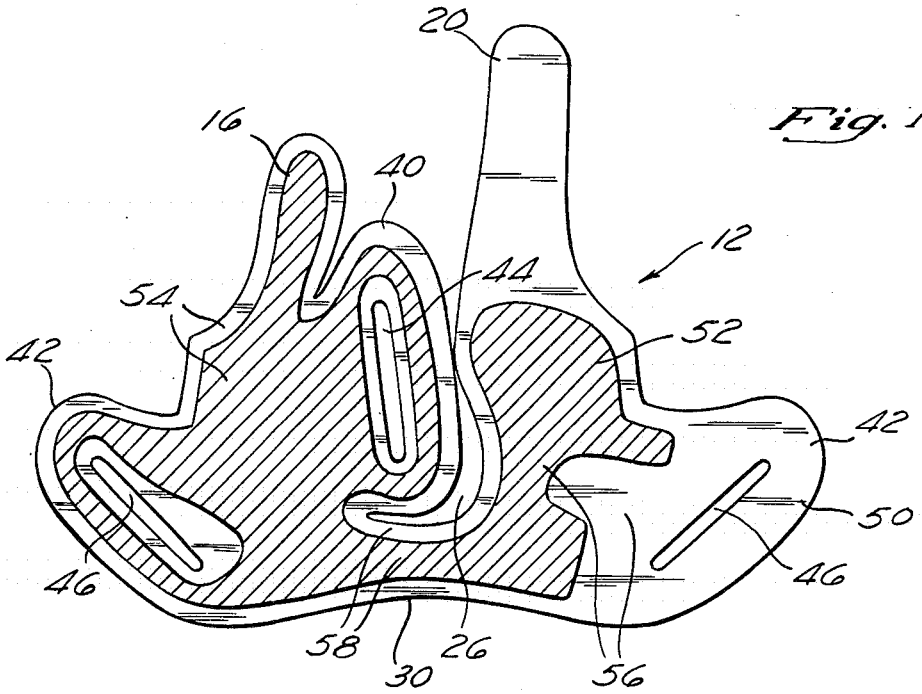
FIG. 10 is a plan view of the metal reinforcement interlayer and of one of two layered leather blanks used to fabricate the revolver pistol holster shown in FIGS. 6–9. The diagonal lines on the metal interlayer are not used to indicate sectioning but instead are used to give adequate visual contrast between the metal interlayer and the leather blank.
Figure 11:
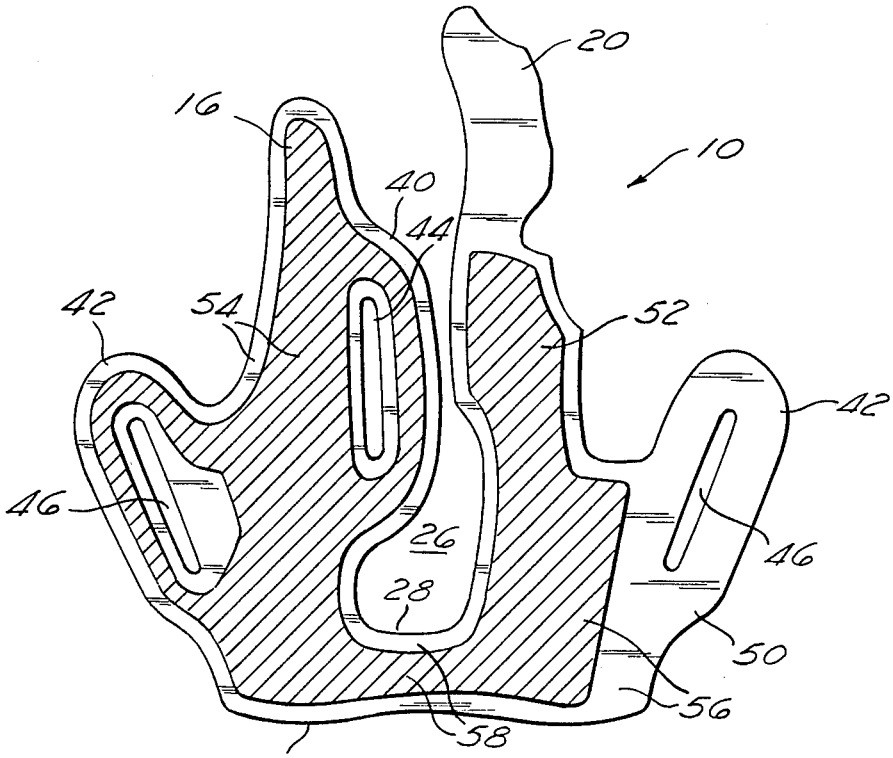
FIG. 11 is like FIG. 10 but relates to the automatic pistol holster shown in FIGS. 1–5.

FIGS. 10 and 11 indicate the leather and metal blanks, 50, 52 respectively, from which the holster is fabricated. FIG. 10 shows blanks for the FIGS. 6–9 revolver pistol holster and FIG. 11 shows blanks for the FIGS. 1–5 automatic pistol holster. FIGS. 10 and 11 only show the lower leather layer 50 and the metal reinforcing interlayer 52, whereas there is a second upper leather layer 50 sandwiched with superimposed to the lower leather ply 50 on either side of metal interlayer 52.

Blanks 50 in flat condition before being folded into the shape of a holster have ear portions 42 at right and left ends. Rear ear 42 in the finished holster is formed by superimposing right and left ear portions 42 and by sewing (or sewing and bonding) them together. Note that metal interlayer blank 52 does not have an ear portion 42 at the right end, thereby avoiding having two thicknesses of metal in rear ear 42.

Blanks 50, 52 have first and second blank wall portions 54, 56 to form holster inner and outer body walls, respectively, in the finished to form holster inner and outer body walls, respectively, in the finished holster, connected by a third blank wall portion 58 to form low forward wall 34 in the finished holster. First and second blank wall portions 54, 56 are unconnected except by third blank wall portion 58 thereby resulting in the open front 26 in the finished holster.

A fourth blank portion extends from first blank wall portion 54 above third blank wall portion 58 to form forward ear 40. A fifth blank portion extending upwardly from first blank portion 54 forms upstanding thumb release part 16 in the finished holster. A sixth blank portion extending upwardly from second blank portion 56 forms retaining strap 20. Note that retaining strap 20 is flexible and hence metal interlayer blank 52 does not extend into the area of strap 20.

The metal interlayer blank 50 can be formed out of 18 or 20 gauge galvanized steel. The leather blanks for a smaller pistol can be formed of 3–4 ounce top grade cowhide. The leather blanks for a larger pistol can be formed of 5–6 ounce top grade cowhide for the outside layer of the holster and 3–4 ounce top grade cowhide for the inside layer of the holster. The holsters produced thus far have been hand fitted and tested using the customer's pistol or another pistol of the exact same model for a form around which the leather and metal blanks 50, 52 are fitted.

Fitting of leather materials in holster fabrication involves a certain amount of deformation of the material, to a good extend substantially reversible, but fitting of metal blank 52 involves setting of the metal more or less permanently, i.e., beyond the yield point of the metal. One important reason for having a metal reinforcement about the weapon is for good permanent fit so that the pistol can slide in and out of the holster with minimum resistance. If instead the holster were all leather about the weapon, the weapon would be partly shaping the holster in each use, which would result in some additional resistance to withdrawal of the weapon. Portions 54, 56, 58 of the metal blank are primarily involved in fitting to the revolver or automatic pistol. The further extension of the metal blank from portions 54, 56, 58 into the areas of foward ear 40 and rear ear 42 results in the pistol having a fixed and tactually felt location relative to belt 48 and to the body of the user. Blank portion 54 and connected ear portions 40, 42 of metal blank 52 are given some curvature to fit the hip and waist area of the user.

Bending of a metal blank wall portin 58 around the front of the pistol barrel, in this type of holster, is thought to be novel in my holster and important in fitting and locating the pistol and insuring its easy withdrawal. Note that prior metal reinforcement in some holsters involved two to four metal pieces located around the cylinder or slide of a pistol. Spring metal pieces have been used in the past to hold a pistol in a holster but the spring holding pressure results in some resistance (and delay) to weapon withdrawal. Such springs are sometimes made adjustable in pressure by the addition of tightening means. This additional resistance to weapon withdrawal is objectionable in a fast draw holster.

If the locations of belt loops 40, 42 are studied in the various Figures of the drawings, it will be observed that the portion of the holsters containing the pistols are tilted relative to the vertical so that the upper end of the weapon is further forward than the barrel of the weapon. This "forward" tilt I prefer to orient at about 25° to the vertical. In FIG. 13, the weapon 24, for example, is oriented at around 25° to a vertical from the belt line, so that the vertical in FIG. 13 is a convenience in illustration but is not the vertical of holster 14 in use, as is demonstrated by lines 60, 62 in FIG. 13, line 60 representing the belt line.

Figure 6:
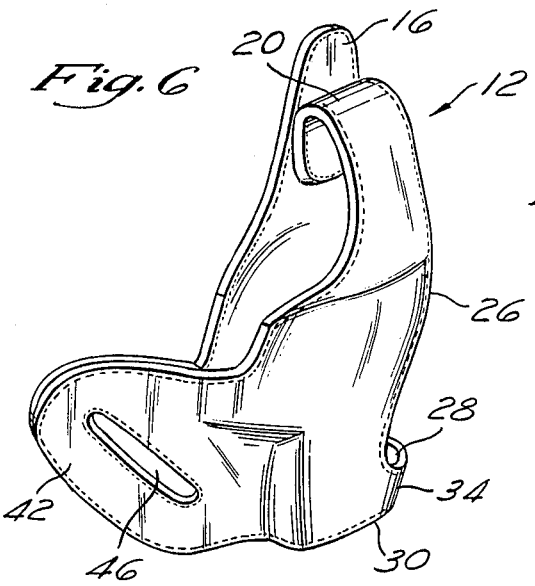
FIG. 6 is a perspective view of an embodiment of my new holster for a revolver pistol. The viewpoint is to the outside and to the rear of the holster.
Figure 7:
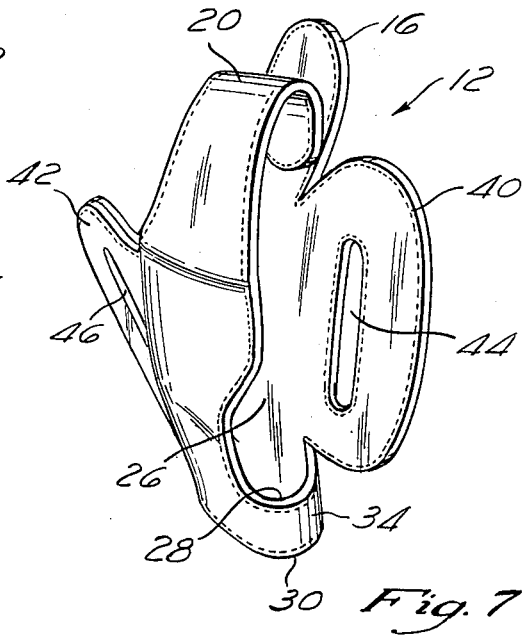
FIG. 7 is like FIG. 6 but the viewpoint is to the outside and to the front of the holster.
Figure 8:
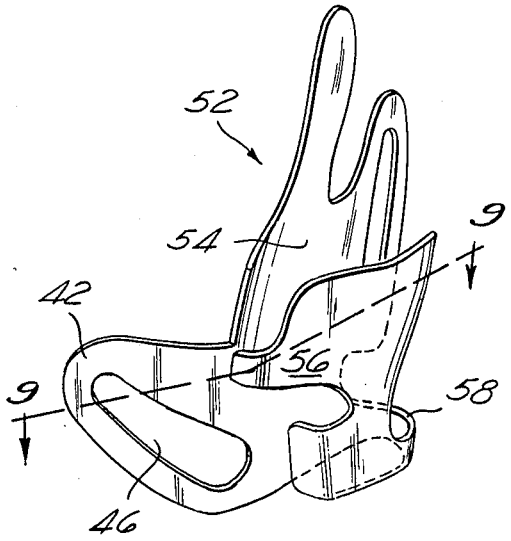
FIG. 8 is a view like FIG. 6 but is only of a metal reinforcement for the holster.
Figure 9:
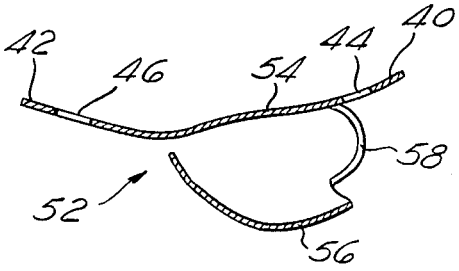
FIG. 9 is a cross-sectional view taken on line 9—9 of FIG. 8.

If especially FIGS. 1 and 6 are contrasted carefully, some difference in holster contour will be noted relating to the difference in shapes between a reolver and an automatic respectively. This difference is also partly reflected in FIGS. 4–5 and 8–9 as to the way metal blanks 52 are edge configured and three-dimensionally shaped. In other words, the edge outlines of the metal blanks 52 and the way they are three-dimensionally shaped are especially related to whether a revoler cylinder or an automatic slide is being fitted. These will be observed to be complex shapes both in the two-dimensional blank conditions of FIGS. 10 and 11 and in the three-dimensional formed conditions of FIGS. 4, 5, 8 and 9.

Whereas I have shown separate belt loops 40–44, it would be possible to adapt holsters 10–14 with a single rear holster flap folding around a belt 48.

For the purposes of the claims, the following terms are defined: The "front" of the holster body and "forward" of the body are toward the viewer in FIG. 3 and to the right in FIG. 13. The "bottom" of the holster body is at the bottoms in FIGS. 3 and 13 and the "top" of the holster body is at the tops in FIGS. 3 and 13. The direction "inner" is on the right in FIG. 3, next to the user, and the direction "outer" is on the left in FIG. 3, away from the user. The direction "rear" of the holster body is away from the viewer in FIG. 3 and to the left in FIG. 13. The directions "upper" and "upwardly" are toward the top in FIGS. 3 and 13.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. A holster for a pistol, comprising:

(a) a body defining said holster formed by two substantially identical layered blanks of leather attached together by sewing, (b) said body having an open front from the top of said body to a level no more than an inch and a quarter from the bottom of said body, said body having a low forward wall bending between an inner body wall next to the user and an outer body wall away from the user and said low forward wall extending vertically between said level and said bottom of said body whereby the barrel of such pistol can be normally retained against forward escape by said low forward wall but such pistol can be removed in a forward direction after lifting until the barrel passes above said low forward wall, (c) said inner body wall including an inner rigid upstanding thumb release part having a female snap member spaced from the upper end of said part and said outer body wall including an outer flexible retaining strap having a male snap member engageable with said female snap member to hold such pistol down in said holster, (d) said body having a forward ear extending fowardly from said inner wall in the area of said open front and said body having a rear ear extending rearwardly from the remainder of said body and said ears being slotted generally vertically whereby said ears form belt loops to install the holster on a belt, (e) said layered blanks in flat condition before being folded into the shape of the holster having a first ear portion at the forward end and a second portion at the rear end and said rear ear being formed by superimposing said ear portions and by sewing them together, said layered blanks in such flat condition having first and second blank wall portions to form said inner and outer body walls connected by a third blank wall portion to form said low forward wall and said first and second blank wall portions being unconnected except for said third blank wall portion thereby forming said open front, said forward ear being formed by a fourth blank ear portion extending from said first blank wall portion above said third blank wall portion, said layered blanks having a fifth blank portion extending upwardly from said first blank wall portion forming said upstanding thumb release part and having a sixth blank portion extending upwardly from said second blank wall portion forming said retaining strap, and (f) a metal sheet between said layered blanks and extending substantially the complete area of said blanks except for the margins of said blanks to be sewed together, except for said first ear portion, and except for said sixth blank portion forming said flexible retaining strap, said metal sheet extending throughout the area of said ears and said fifth blank portion forming said upstanding thumb release.

2. A holster for a pistol, comprising:

(a) a body defining said holster formed by two substantially identical layered blanks of leather attached together, (b) said body having an open front from the top of said body to a level no more than a quarter of the height of said body from the bottom of said body, said body having a low forward wall bending between an inner body wall next to the user and an outer body wall away from the user and said low forward wall extending vertically between said level and said bottom of said body whereby the barrel of such pistol can be normally retained against forward escape by said low forward wall but such pistol can be removed in a forward direction after lifting until the barrel passes above said low forward wall, (c) said inner body wall including an inner rigid upstanding thumb release part having a first snap member spaced from the upper end of said part and said outer body wall including an outer flexible retaining strap having a second snap member engageable with said first snap member to hold such pistol down in said holster, (d) said body having a forward ear extending forwardly from said inner wall in the area of said open front and said body having a rear ear extending rearwardly from the remainder of said body and said ears being slotted generally vertically whereby said ears form belt loops to install the holster on a belt, and (e) said layered blanks in flat condition before being formed into the shape of the holster having a first ear portion at the forward end and a second ear portion at the rear end and said rear ear being formed by superimposing said ear portions and by sewing them together, said layered blanks in such flat condition having first and second blank wall portions to form said inner and outer body walls connected by a third blank wall portion to form said low forward wall and said first and second blank wall portions being unconnected except for said third blank wall portion thereby forming said open front, said forward ear being formed by a fourth blank ear portion extending from said first blank wall portion above said third blank wall portion, said layered blanks having a fifth blank portion extending upwardly from said first blank wall portion forming said upstanding thumb release part and having a sixth blank portion extending upwardly from said second blank wall portion forming said retaining strap.

3. A holster for a pistol, comprising:

(a) a body defining said holster formed by two substantially identical layered blanks of leather attached together, (b) said body having an open front from the top of said body to a level no more than an inch and a quarter from the bottom of said body, said body having a low forward wall bending between an inner body wall next to the user and an outer body wall away from the user and said low forward wall extending vertically between said level and said bottom of said body whereby the barrel of such pistol can be normally retained against forward escape by said low forward wall but such pistol can be removed in a forward direction after lifting until the barrel passes above said low forward wall, (c) said inner body wall including an inner rigid upstanding thumb release part having a first snap member spaced from the upper end of said part and said outer body wall including an outer flexible retaining strap having a second snap member engageable with said first snap member to hold such pistol down in said holster, (d) said body having a forward ear extending forwardly from said inner wall in the area of said open front and said body having a rear ear extending rearwardly from the remainder of said body and said ears being slotted generally vertically whereby said ears form belt loops to install the holster on a belt, and (e) a metal sheet between said layered blanks and extending substantially the complete area of said blanks except for the margins of said blanks to be attached together and except for said flexible retaining strap, said metal sheet being provided in the area of said ears and in the area of said upstanding thumb release part, said metal sheet having a single thickness in the areas of said ears.

4. A holster for a pistol, comprising:

(a) a body defining said holster formed by two substantially identical layered blanks of leather attached together, (b) said body having an open front from the top of said body to a level no more than a quarter of the height of said body from the bottom of said body, said body having a low forward wall bending between an inner body wall next to the user and an outer body wall away from the user and said low forward wall extending vertically between said level and said bottom of said body whereby the barrel of such pistol can be normally retained against forward escape by said low forward wall but such pistol can be removed in a forward direction after lifting until the barrel passes above said low forward wall, (c) said inner body wall including an inner rigid upstanding thumb release part having a first snap member spaced from the upper end of said part and said outer body wall including an outer flexible retaining strap having a second snap member engageable with said first snap member to hold such pistol down in said holster, and (d) said body having a forward ear extending forwardly from said inner wall in the area of said open front and said body having a rear ear extending rearwardly from the remainder of said body and said ears being slotted generally vertically whereby said ears form belt loops to install the holster on a belt.

5. A holster for a pistol, comprising:

(a) a body defining said holster formed by two substantially identical layered blanks of leather attached together, (b) said body having an open front from the top of said body to a level no more than an inch and a quarter from the bottom of said body, said body having a low forward wall bending between an inner body wall next to the user and an outer body wall away from the user and said low forward wall extending vertically between said level and said bottom of said body whereby the barrel of such pistol can be normally retained against forward escape by said low forward wall but such pistol can be removed in a forward direction after lifting until the barrel passes above said low forward wall, (c) said body having means to install the holster on a belt, and (d) a metal sheet between said layered blanks and extending substantially the complete area of said blanks except for the margins of said blanks to be attached together, said metal sheet being provided in the area of said low forward wall by bending between areas of said metal sheet corresponding to said inner and outer body walls.

* * * * *